US006074204A

United States Patent [19]

Audebert et al.

[11] Patent Number: 6,074,204

[45] **Date of Patent: *Jun. 13, 2000**

[54] DEVICE FOR TRANSFERRING PRODUCTS IN PLANTS FOR METALLURGICAL TREATING OF SAID PRODUCTS

[75] Inventors: Jean-Claude Audebert, Evry; Daniel Marie, Rambouillet; Frédéric Martin, Orsay, all of France

[73] Assignee: Stein Heurtey, Ris-Orangis, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/122,776

[22] Filed: Jul. 27, 1998

[30] Foreign Application Priority Data

Jul. 31, 1997 [FR] France ..... 97 09824

[51] Int. Cl.[7] ..... F27B 9/00; F27D 3/00

[52] U.S. Cl. ..... 432/121; 432/122; 432/126; 432/128; 198/774.4

[58] Field of Search ..... 432/121, 122, 432/126, 128, 127, 234; 198/774.4

[56] References Cited

U.S. PATENT DOCUMENTS

| | | | |
|---|---|---|---|
| 3,658,171 | 4/1972 | Fukada | 198/774.4 |
| 5,139,418 | 8/1992 | Rigan et al. | 432/122 |
| 5,514,853 | 5/1996 | Le Viet | 219/700 |

FOREIGN PATENT DOCUMENTS

| | | |
|---|---|---|
| 0 429 355 | 5/1991 | European Pat. Off. . |
| 0 453 329 | 10/1991 | European Pat. Off. . |
| 0 514 757 | 11/1992 | European Pat. Off. . |
| 995298 | 11/1951 | France . |
| 1232996 | 1/1967 | Germany . |
| 34 40 048 | 3/1986 | Germany . |
| 61-279615 | 10/1986 | Japan . |

*Primary Examiner*—Henry Bennett
*Assistant Examiner*—Jiping Lu
*Attorney, Agent, or Firm*—Pollock, Vande Sande & Amernick

[57] ABSTRACT

An assembly for treating metal products is presented. The assembly includes a preheat furnace aligned with a reheat furnace. Cold products are initially heated in the preheat furnace and hot products bypass the preheat furnace. A material handling device is provided for a) transferring preheated products from an outlet of the preheat furnace to an inlet of the reheat furnace, and for b) transferring hot products from a point between the furnaces to the inlet of the reheat furnace. The material handling device includes a support extending between the outlet of the preheat furnace and the inlet of the reheat furnace for receiving preheated and hot products; and a displacement device located below the support means for lifting and translating preheated and hot products from the support means to the inlet of the reheating means.

6 Claims, 4 Drawing Sheets

DEVICE FOR TRANSFERRING PRODUCTS IN PLANTS FOR METALLURGICAL TREATING OF SAID PRODUCTS

FIELD OF THE INVENTION

The present invention relates to a device for the treatment of iron and steel products in metallurgical furnaces. It relates more specifically to a transfer device allowing iron and steel products, such as billets, blooms, slabs and blanks, coming from a production site located upstream, especially of the continuous casting, rolling mill or storage yard type, to be loaded into reheat furnaces before they are used in a production site located downstream, particularly a hot-rolling mill.

Another aspect of the invention also consists of a plant for the metallurgical treatment of iron and steel products, in which the geographical location of a first, so-called preheat furnace and of a second, so-called reheat furnace is optimized depending on the use of the transfer device according to the other aspect of the invention.

BACKGROUND OF THE INVENTION

For reasons of saving energy, of increasing productivity and of improving the quality, it is desired to charge reheat furnaces continuously with hot products coming directly from the continuous casting run. However, it may happen that the process is interrupted for various reasons—the continuous casting suspends its production or the latter is insufficient to feed the hot-rolling plant—and in this case, it is necessary either to provide cold products from a storage yard or periodically to supplement the production of hot products from the continuous casting run with the same cold products from the storage yard.

Feeding the hot-rolling mill with a batch of products not having the same temperature causes quality problems in the outgoing products from the furnace. Overheating phenomena in hot products or underheating problems in cold products occur, causing energy losses and/or abnormal formation of scale.

Plants exist which partly solve the abovementioned drawbacks.

Thus, a first solution is known which consists in using a plant allowing intermediate furnace charging with hot products. A furnace is charged with cold products as soon as the furnace is started up. A furnace is charged with hot products via a side door in the furnace, at a point where the cold products have been able to reach the temperature of the hot products with which the furnace was charged.

However, this solution has a major drawback which limits its application. This is because side charging requires the use of an actual insertion device which is not easy to manipulate and which therefore is generally used only for charging with small-sized products (billets and possibly small blooms).

Moreover, a second solution is known which consists in using a reheat furnace. In this case, a reheat furnace is charged with hot products. With regard to cold products, they are introduced into a preheat furnace which heats them to the temperature of the hot products, before being transferred and then loaded with the hot products.

Again, this solution has a major drawback. This is because in this application the cold products arrive at the preheat furnace via roller tables. A loading device takes them and deposits them in the furnace. The cold products are then preheated to the temperature of the hot products and then unloaded by means of an unloading device and deposited on roller tables.

The hot products and the preheated cold products are then transported to the reheat furnace and are then seized by means of another loading device and taken into the reheat furnace in which they are heated to the hot-rolling temperature.

The use of a preheat plant necessarily requires the use of a certain number of loading and unloading devices and of transfer devices (roller tables), which result not only in an offset arrangement of the two furnaces—the preheat furnace and the reheat furnace—and hence a significant amount of the floor space being taken up, but also greater cooling of the products between the two furnaces, which phenomenon runs counter to reducing energy consumption.

BRIEF DESCRIPTION OF THE INVENTION

The object of the present invention is therefore to help to overcome the drawbacks of the solutions known from the prior art by providing a device which improves and simplifies the transfer of metallurgical products between the preheat furnace and the reheat furnace, which can consequently be placed face to face (or aligned).

For this purpose, the transfer device positioned between a first furnace and a second furnace for the metallurgical treatment of iron and steel products initially placed on stationary longitudinal members, which forms the subject of the invention, includes a frame provided with an assembly consisting of the juxtaposition of a plurality of movable longitudinal members and optionally of a plurality of rollers. The movable longitudinal members engaging both with a lifting/depositing frame and with a forward/rear translation frame, the said frames allowing the movable longitudinal members to describe a movement of rectangular pitch so as to transfer the iron and steel products between the first and second furnace, or so as to load the iron and steel products into the second furnace.

For this purpose, the plant for the metallurgical treatment of iron and steel products includes a first, preheat furnace, one of the ends of which faces a transfer device, which ensures continuity with a second, reheat furnace, the iron and steel products being fed into the first, preheat furnace and/or into the second, reheat furnace.

Other characteristics and advantages of the present invention will emerge from the description given below with reference to the appended drawings which illustrate an embodiment thereof which is devoid of any limiting character. In the figures:

DETAILED DESCRIPTION OF THE INVENTION

Figure 1:
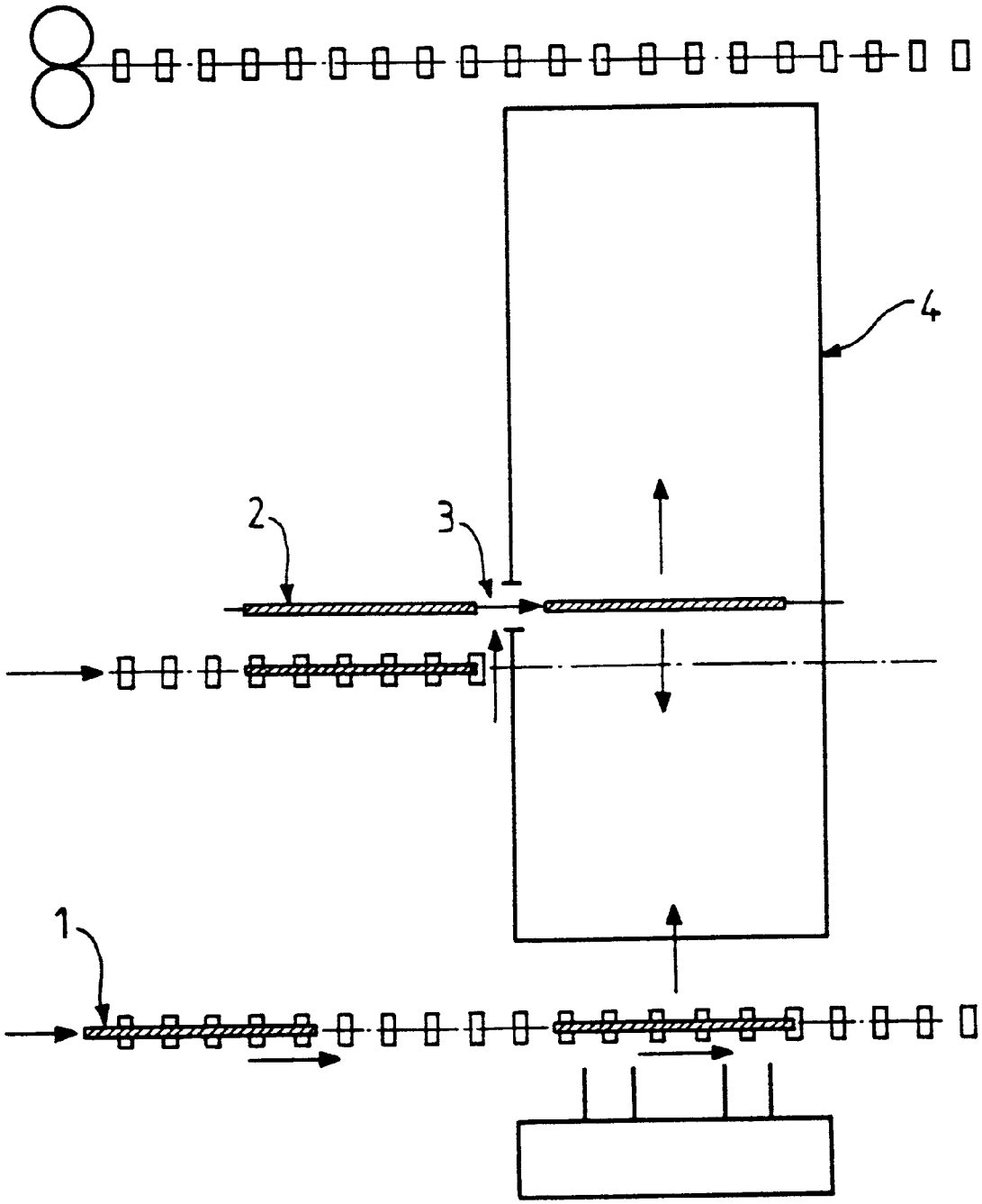
FIG.1 PRIOR ART
FIG. 1 illustrates the use of a plant according to the prior art (intermediate loading)

In FIG. 1, the cold products are denoted by the reference number 1 while the hot products are denoted by the reference number 2. The cold products are loaded at the entrance of the furnace 4 while the hot products are introduced via a side opening 3 made in the furnace 4.

Figure 2:
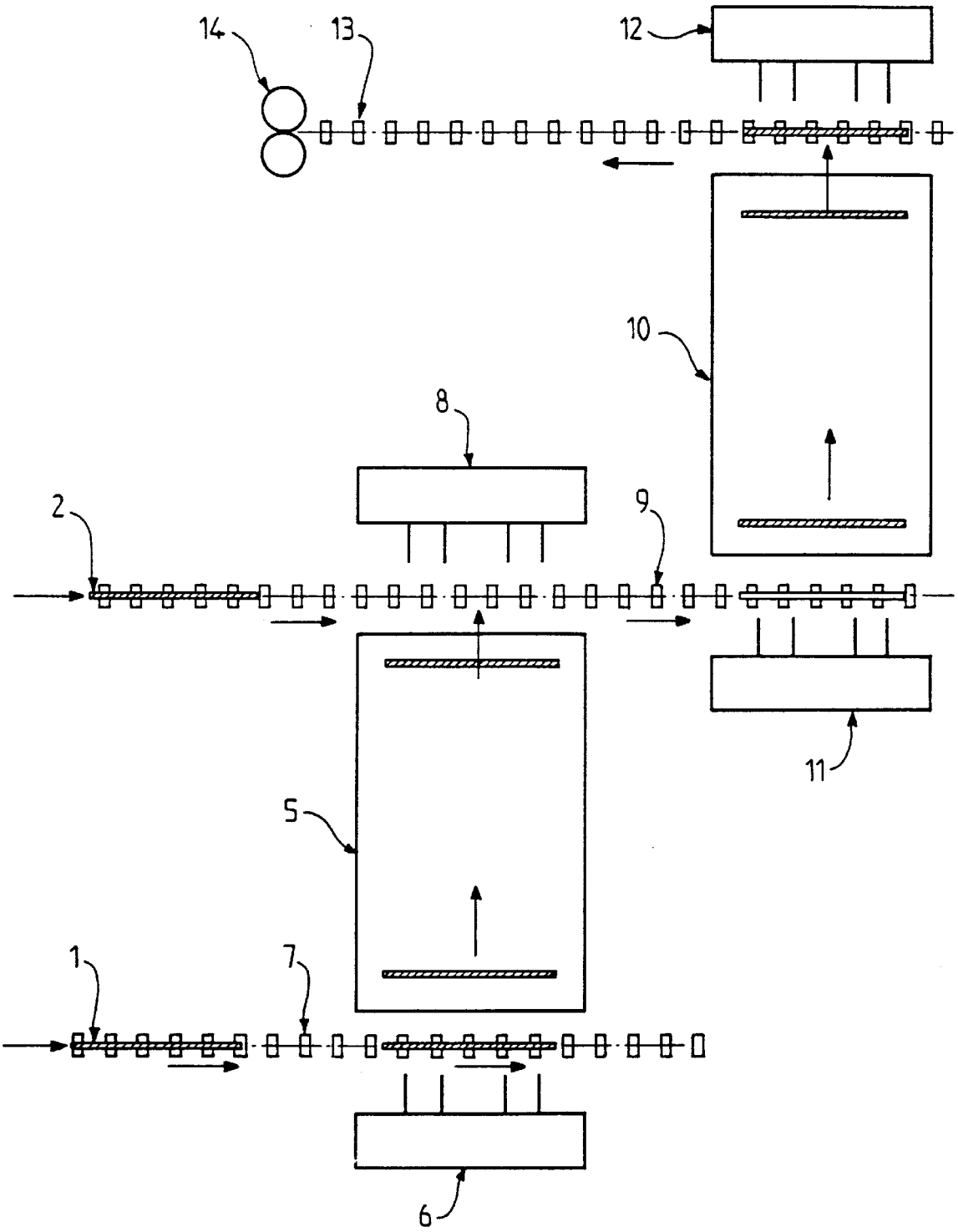
PRIOR ART FIG. 2
FIG. 2 illustrates the use of another plant according to the prior art (preheat furnace)

In FIG. 2, the cold products are represented by the reference number 1 and the hot products by the reference number 2. The cold products 1, after having travelled by means of a transfer device 7, are introduced into a preheat furnace 5 by means of a loading device 6. After having passed through the preheat furnace 5, the cold products, which are heated up, are discharged by means of an unloading device 8 and are then positioned on another transfer line 9 which conveys them, at the same time as the hot products 2, to the reheat furnace 10 which has to bring the temperature of these products to the hot-rolling temperature. The hot products 2 and the cold products 1 are loaded, by means of a device 11, into the furnace 10 and extracted therefrom by means of a device 12. The latter places the products, which have reached the desired rolling temperature, on a transfer line 13 which conveys them to the rolling mill 14.

Figure 3:
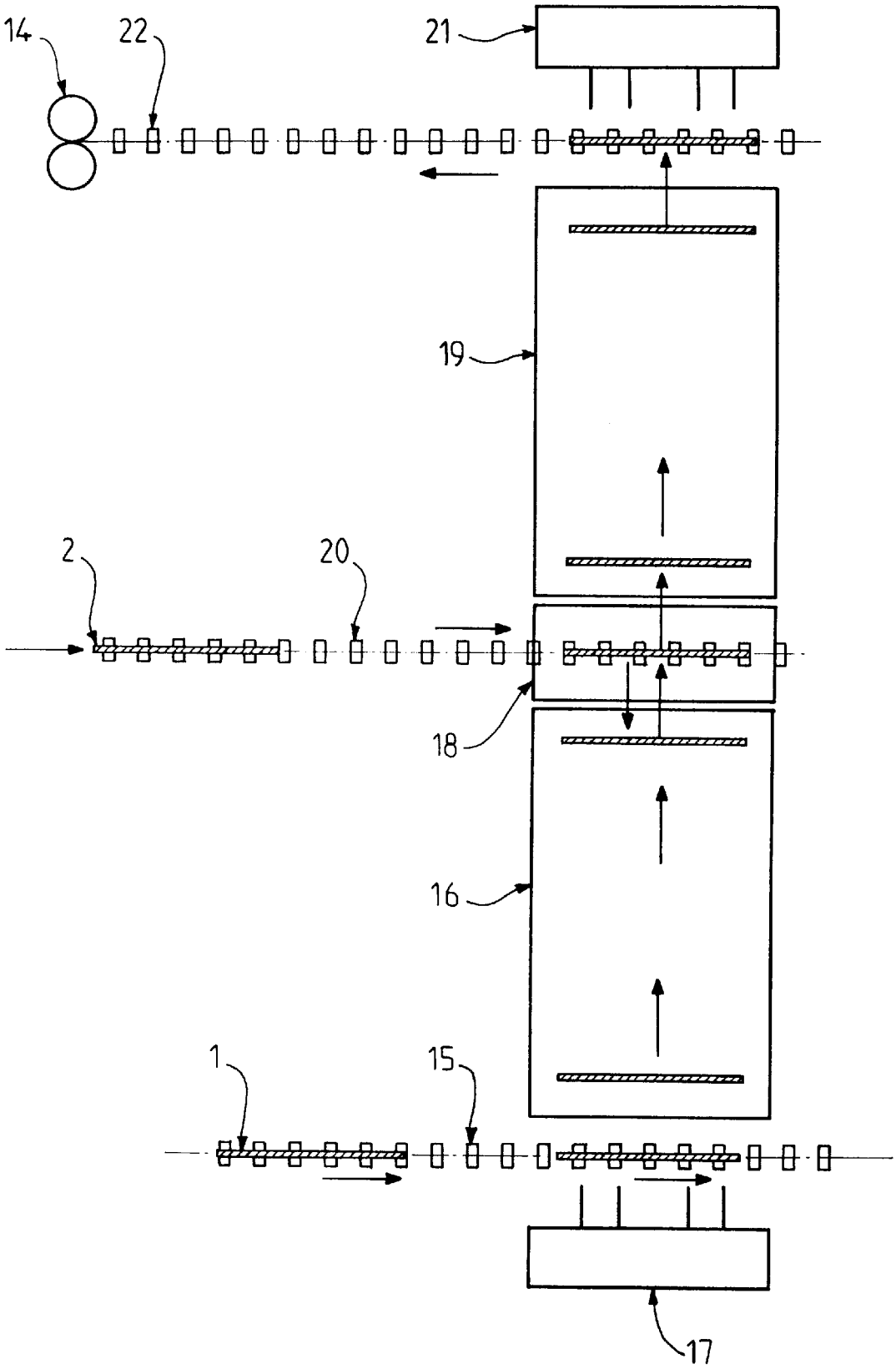
FIG. 3 is a view illustrating the integration of the device forming the subject of the invention between a preheat furnace and a reheat furnace.

In FIG. 3, the cold products have been represented by the reference number 1, the hot products by the reference number 2 and the rolling mill by the reference number 14.

The cold products 1 travel, by means of a transfer line 15 (roller table), to the preheat furnace 16. These products 1 are introduced, by means of a loading device 17, into the furnace 16. As they travel through the furnace 16, the cold products reach the temperature of the hot products 2.

A transfer device 18, which forms the subject of the invention, is positioned between the preheat furnace 16 and the reheat furnace 19. This transfer device 18 handles the cold products 1 preheated to the temperature of the hot products 2 (the latter arriving at the device 18 by means of a transfer device 20).

When the products 1 and 2 are introduced into the reheat furnace 19 and, after having travelled through 19 in order to reach the suitable temperature for the purpose of rolling, they are extracted by means of an unloading device 21 which deposits them on a transfer line 22 going towards the hot-rolling mill 14.

Figure 4:
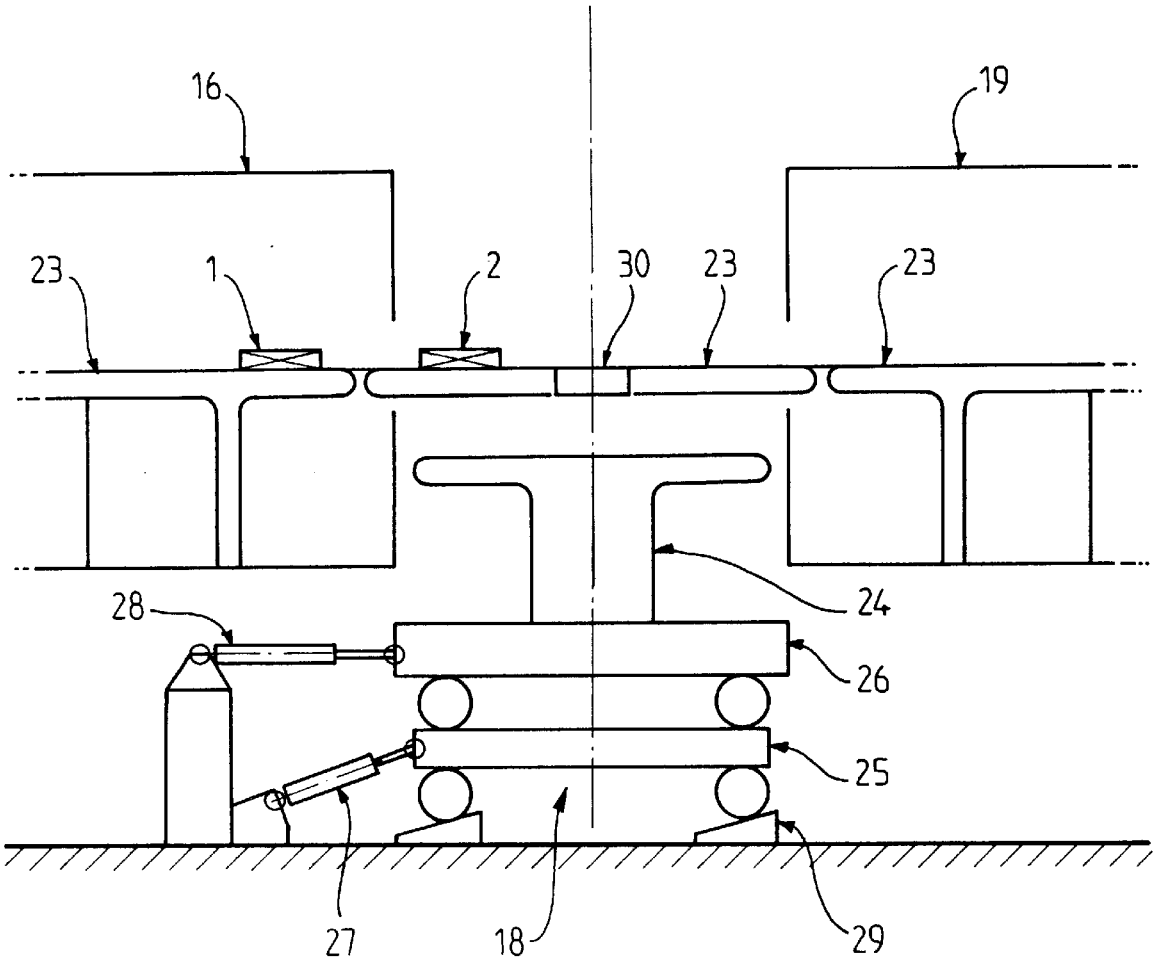
FIG. 4 is a cross-sectional view, in side elevation, of the device forming the subject of the invention.

According to a preferred embodiment of the transfer device 18 forming the subject of the invention, this device comprises (the reader is referred to FIG. 4) a frame placed between the preheat furnace 16 and the reheat furnace 19. This frame is provided with an assembly consisting of a juxtaposition of a plurality of movable longitudinal members 24 and of a plurality of rollers 30, the latter being positioned in the same plane and so as to be continuous with the transfer means 20. Stationary longitudinal members 23 also lie in the same plane as the hearth of the preheat furnace 16 and the hearth of the reheat furnace 19, as well as in a plane parallel to the transfer means 20 (roller table) which conveys the hot products 2.

According to another embodiment, the rollers 30 are not incorporated in the frame of the transfer device 18 but are attached, substantially in the same plane as the stationary longitudinal members 23, to a subsidiary frame which engages for example, with the preheat furnace 16 and with the reheat furnace 19.

The movable longitudinal members 24 move with a rectangular pitch consisting of four main movements:

a lifting movement, a forward translation movement, a depositing movement, and a rear translation movement.

The movable longitudinal members 24 engage both with a lifting and depositing frame 25 and with a forward/rear translation frame 26. The lifting/depositing movements of the frame 25 and the forward/rear translation movements of the frame 26 are provided by mechanical, hydraulic or other lifting means 27 and translation means 28, respectively.

Firstly, products 1 leaving the preheat furnace 16 are positioned so as to bear on the stationary longitudinal members 23. The lifting frame 25 is then in the low position and the translation frame 26 in the rear position. In this configuration, the movable longitudinal members 24 are then below the products 1 to be transferred to the reheat furnace 19.

Secondly, the lifting means 27 (by means of the combined action of cylinders and of inclined faces 29) raise the frame 25 and therefore the movable longitudinal members 24, thereby lifting the products 1.

Thirdly, the means 28 move the translation frame 26 translationally forwards so as to transfer the products 1 which are on the movable longitudinal members 24 into the reheat furnace 19.

Fourthly, the lifting means 27 position the movable longitudinal members 24 so as to be level with the stationary longitudinal members 23 lying in the same plane as the hearth of the furnace 19 so as to deposit the products 1 in the reheat furnace 19.

The final operation consists in bringing the translation frame 26 and the movable longitudinal members 24 which engage therewith into the rear position, using the translation means 28, which constitutes the initial position of the cycle.

Of course, the movement of the movable longitudinal members 24, by means of the frames 25 and 26, with respect to the products 1 is identical to the operation of these same longitudinal members 24 in the case of transferring products 2 from the transfer line 20 into the furnace 19. In this case, the stationary rollers 30 act as the stationary longitudinal members 23, the stationary rollers 30 being positioned on the end of and substantially in the same plane as the transfer line 20.

The invention as described above offers many advantages. It allows the aligned arrangement of the preheat and reheat furnaces, thereby saving a considerable amount of floor space. It also allows hot products to be loaded into the preheat furnace so as to constitute a temporary hot storage area when the rolling mill is stopped and when the continuous casting line is in operation.

Of course, it remains to be stated that the present invention is not limited to the embodiments described and illustrated above but encompasses any variant thereof.

What is claimed is:

1. In an assembly for treating hot and cold metal products, the assembly comprising:

a preheat furnace having an outlet oppositely confronting an inlet of a reheat furnace;

first conveyance means for conveying cold products along a first path leading to an inlet of the preheat furnace, the cold products being initially heated in the preheat furnace during movement of the cold products through the preheat furnace along a second path that is substantially perpendicular to the first path;

second conveyance means for conveying hot products along a third path substantially parallel to the first path and leading to the inlet of the reheat furnace thereby bypassing the preheat furnace;

a material handling device for transferring preheated products from the outlet of the preheat furnace to the inlet of the reheat furnace, and/or for transferring hot products from a point between the furnaces to the inlet of the reheat furnace, the material handling device including support means extending between the outlet of the preheat furnace and the inlet of the reheat furnace for receiving preheated cold products from the preheat furnace or hot products from the third path;

means located below the support means for lifting and translating these products from the support means to the inlet of the reheating and for selectively reversing movement of products from the support means to the preheat furnace, through the outlet thereof, for temporary hot storage therein.

2. The material handling device of claim 1 wherein the lifting and translating means executes rectangular motion during a complete cycle of operation, returning the lifting and translating means to an original position.

3. The material handling device of claim 1 wherein the lifting and translating means executes rectangular motion during a complete cycle of operation, returning the lifting and translating means to an original position and including four phases;

a) lifting;

b) forward translation;

c) depositing; and d) rear translation.

4. In a method for treating hot and cold metal products including a preheat furnace having an outlet oppositely confronting an inlet of a reheat furnace, the method comprising the steps:

conveying cold products along a first path leading to an inlet of the preheat furnace, the cold products being initially heated in the preheat furnace during movement of the cold products through the preheat furnace along a second path that is substantially perpendicular to the first path;

conveying hot products along a third path substantially parallel to the first path and leading to the inlet of the reheat furnace thereby bypassing the preheat furnace;

a material handling process for transferring preheated products from an outlet of the preheat furnace to the inlet of the reheat furnace, and for transferring hot products from a point between the furnaces to the inlet of the reheat furnace, the material handling process including the steps providing a support between the outlet of the preheat furnace and the inlet of the reheat furnace for receiving preheated cold products from the preheat furnace or hot products;

and subjecting the cold and hot products to lifting and displacement from a location below the support for lifting and translating these products from the support to the inlet of the reheat furnace; and for selectively reversing movement of hot products from the support means to the preheat furnace, through the outlet thereof, for temporary hot storage therein.

5. The method set forth in claim 4 wherein rectangular motion is executed during a complete cycle of operation of lifting and translating.

6. The method set forth in claim 5 wherein the rectangular motion occurs in four phases including:

a) lifting;

b) forward translation;

c) depositing; and d) rear translation.

* * * * *